United States Patent [19]

Nowell

[11] 4,224,704

[45] Sep. 30, 1980

[54] ADJUSTABLE AND FOLDABLE BED FRAME

[75] Inventor: Richard A. Nowell, Carlsbad, Calif.

[73] Assignee: Harris-Hub Co., Inc., Harvey, Ill.

[21] Appl. No.: 956,186

[22] Filed: Oct. 30, 1978

[51] Int. Cl.[2] ..... A47C 19/00

[52] U.S. Cl. ..... 5/181; 5/200 R; 403/107

[58] Field of Search ..... 5/176 R, 181, 184, 200 R, 5/201, 203; 403/107, 108

[56] References Cited

U.S. PATENT DOCUMENTS

| | | | |
|---|---|---|---|
| 3,123,837 | 3/1964 | Paine et al. | 5/181 |
| 3,757,361 | 9/1973 | Harris et al. | 5/184 |
| 3,795,022 | 3/1974 | Harris | 5/184 |
| 4,078,270 | 3/1978 | Nowell | 5/181 |

*Primary Examiner*—Casmir A. Nunberg

*Attorney, Agent, or Firm*—Dressler, Goldsmith, Shore, Sutker & Milnamow, Ltd.

[57] ABSTRACT

An adjustable and foldable bed frame includes a pair of side rails and a pair of end rails extending transversely between the side rails. Each end rail includes a pair of elongated elements, with each of the elements having one end secured to a corresponding side rail and the other end of each element is in slidable relationship to the other element. The elements are releasably locked together by means of a protrusion on one element which is receivable in an opening in the other element. The opening defines a plurality of teeth, and the element with the protrusion has a spring loaded pawl member which is received in the opening and engages the teeth one at a time and permits the elements to be moved inwardly toward one another, while engagement between the pawl and the teeth prevents the elements from moving outwardly relative to one another.

Brackets are provided for pivotably mounting each of the elements to the respective side rails so that the elements can be rotated between a working position generally perpendicular to the respective side rails and a position generally parallel to and alongside the respective side rails. The bracket has one end secured to an element and an opposite end pivotably mounted to the side rail as with a rivet.

17 Claims, 7 Drawing Figures

ADJUSTABLE AND FOLDABLE BED FRAME

BACKGROUND OF THE INVENTION

This invention relates to bed frames and, more particularly, to bed frames which have an adjustable width and which are foldable to a compact position.

Bed frames for supporting a box spring and mattress above a floor typically include a pair of spaced, parallel, horizontally disposed side rails, and a pair of spaced, parallel, horizontally disposed end rails which extend substantially transversely between the side rails for holding the side rails in spaced, parallel relationship. The end rails typically comprise a pair of elements which are locked together.

A problem has long existed in the art because conventional frame members of the above type have not provided positive interlocking engagement between the end rail elements and have required the use of a large number of fasteners. As a result, the assembly and disassembly of the end rail elements is time consuming and complicated and if, by chance, the width has been assembled too narrow or too wide for the particular box spring and mattress, the box spring and mattress should be completely removed before any readjustment of the width can be made.

Commonly assigned U.S. Pat. No. 4,078,270 to Nowell attempts to overcome this problem by providing means for fastening together the elements of a transverse member of a bed frame while still allowing for adjustments in the width of the bed frame. However, one of the disclosed embodiments is a relatively complicated structure which includes a sleeve that circumscribes and protrudes outwardly from both transverse elements. In the other disclosed embodiment, the fastening means provides for adjustments in the transverse width, but does not fasten the two transverse elements together; the two elements are in the shape of C-shaped channels which are received with one another to restrain the elements in all directions except axially.

Commonly assigned U.S. Pat. No. 3,757,361 to Harris et al. discloses an adjustable transverse member that has rivets on one transverse element that are receivable in keyhole slots in the other transverse element. However, the width of the transverse member can be adjusted only to the predetermined spacing of the rivets and keyhole slots. Accordingly, variations in width can be made to accommodate queen-size or king-size bedding, but slight adjustments in width to compensate for minor variations in width of an inch or so for a particular size of bedding, such as queen-size, cannot be readily made.

Another problem with prior art bed frames is to minimize the amount of space required for shipping the bed frames while maximizing the ease of assembling the bed frames. One attempt at solving this problem is disclosed in U.S. Pat. No. 3,123,837 to Paine et al. which teaches a bed frame that has end rail elements that are folded to a position parallel to the side rails. However, in the folded position, a relatively wide space is inherently produced between the end rail elements and the respective side rails. As a result, relatively large shipping containers are required for the bed frames.

The aforementioned patent to Nowell also discloses transverse elements which are rotatable relative to the side members, but is limited to a structure where the transverse elements are nested within the side members when folded.

SUMMARY OF THE INVENTION

The foregoing disadvantages of the prior art are overcome in accordance with the present invention which includes a pair of side rails and a pair of end rails extending transversely between the side rails. Each end rail includes first and second elongated elements each having at least one wall with an outer surface and an inner surface. The first element has a first end mounted to one end of one of the side rails and the second element has a first end mounted to one end of the other side rail. Each of the end rail elements has a second end disposed in slidable relationship to one another along the axis of the elements with the outer surface of the wall of the first element facing and engaging the inner surface of the wall of the second element.

To releasably lock together the end rail elements while permitting axial movement to adjust the width, at least one protrusion extends outwardly from the outer surface of the wall of the first element, and at least one elongated opening is defined in the wall of the second element. The protrusion can be inserted and received in the opening when the first and second elements are positioned in engagement with one another. The opening has an edge which defines a plurality of teeth extending along the axis of the second element. Spring loaded pawl means is secured to the first element and is receivable in the opening to engage the teeth one at a time. The teeth face in a direction such that the pawl is free to ride over the teeth when the first and second elements are moved inwardly toward one another. Engagement between the pawl and one of the teeth prevents the first and second elements from moving outwardly relative to one another.

Means is provided for pivotably mounting each of the first and second elements to the respective side rails so that the elements can be rotated between a working position generally perpendicular to the respective side rails and a position more suitable for transport in which the elements are generally parallel to and along side the respective side rails. The mounting means may comprise a plate having one end secured to the first end of one of the elements and an opposite end which is pivotably mounted to one of the side rails.

DESCRIPTION OF THE PREFERRED EMBODIMENTS

Figure 1:
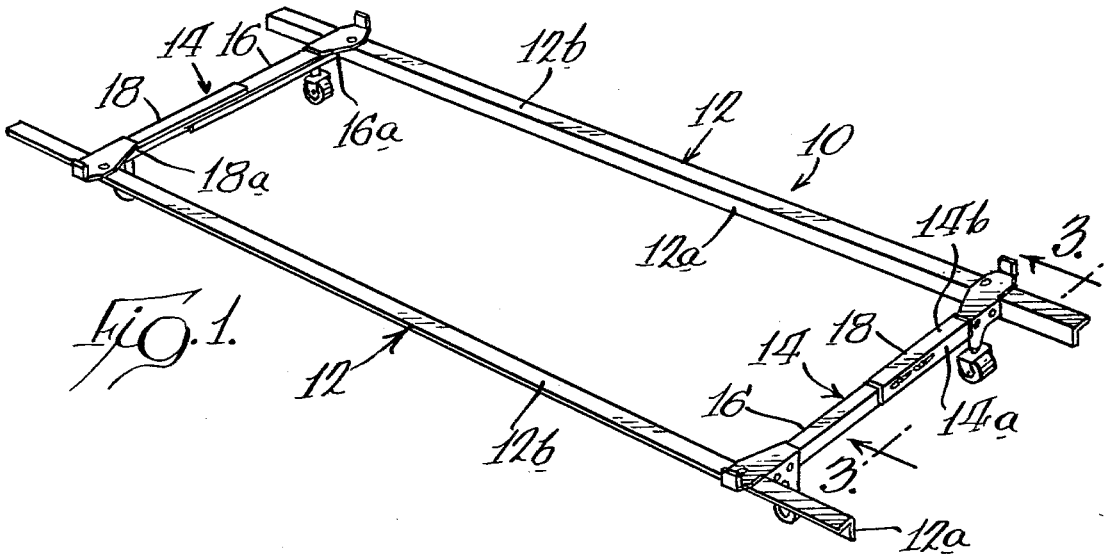
FIG. 1 is a perspective view of a bed frame incorporating the present invention.

While this invention is susceptible of embodiment in many different forms, there are shown in the drawings and herein will be described in detail preferred embodiments of the invention, with the understanding that the present disclosure is to be considered as an exemplification of the principles of the invention and is not intended to limit the invention to the embodiments illustrated. The scope of the invention will be pointed out in the appended claims.

Referring first to FIG. 1, there is shown an adjustable bed frame designated generally by the reference numeral 10. The bed frame supports mattress means, such as a box spring and mattress, in spaced relationship to a floor and includes a pair of spaced, parallel, horizontally disposed side rails 12 and a pair of spaced, parallel, horizontally disposed end rails 14. The end rails extend substantially transversely between the side rails for holding the side rails in spaced, parallel relationship. The upper surfaces of the end rails and side rails are generally coplanar and are adapted to engage and support a box spring and mattress.

Each end rail includes a pair of elongated elements 16 and 18 each having at least one wall with an inner surface 20 and 22, respectively, and an outer surface 21 and 23, respectively. The first element 16 has a first end **16*a* mounted to one of the side rails, preferably adjacent to one end of the side rail, and the second element 18 has a first end 18*a* mounted to the other side rail. Each of the elements has a second end 16*b* and 18*b* which are disposed in slidable relationship to one another along the axis of the elements 16 and 18, with the outer surface 21 of the wall of the first element 16 facing and engaging the inner surface 22 of the wall of the second element 18, as shown in FIG. 4**.

In accordance with the present invention, the first and second elements 16 and 18 are releasably secured together and are movable axially relative to one another to adjust the width of the bed frame. To accomplish this, at least one protrusion 24 extends outwardly from the outer surface 21 of the wall of the first element 16. At least one elongated opening 26 is defined in the wall of the second element 18. The protrusion 24 is insertable in the opening 26 and is received in the opening when the first and second elements 16 and 18 are positioned in engagement with one another, as shown in FIGS. 3 and 4.

Figure 2:
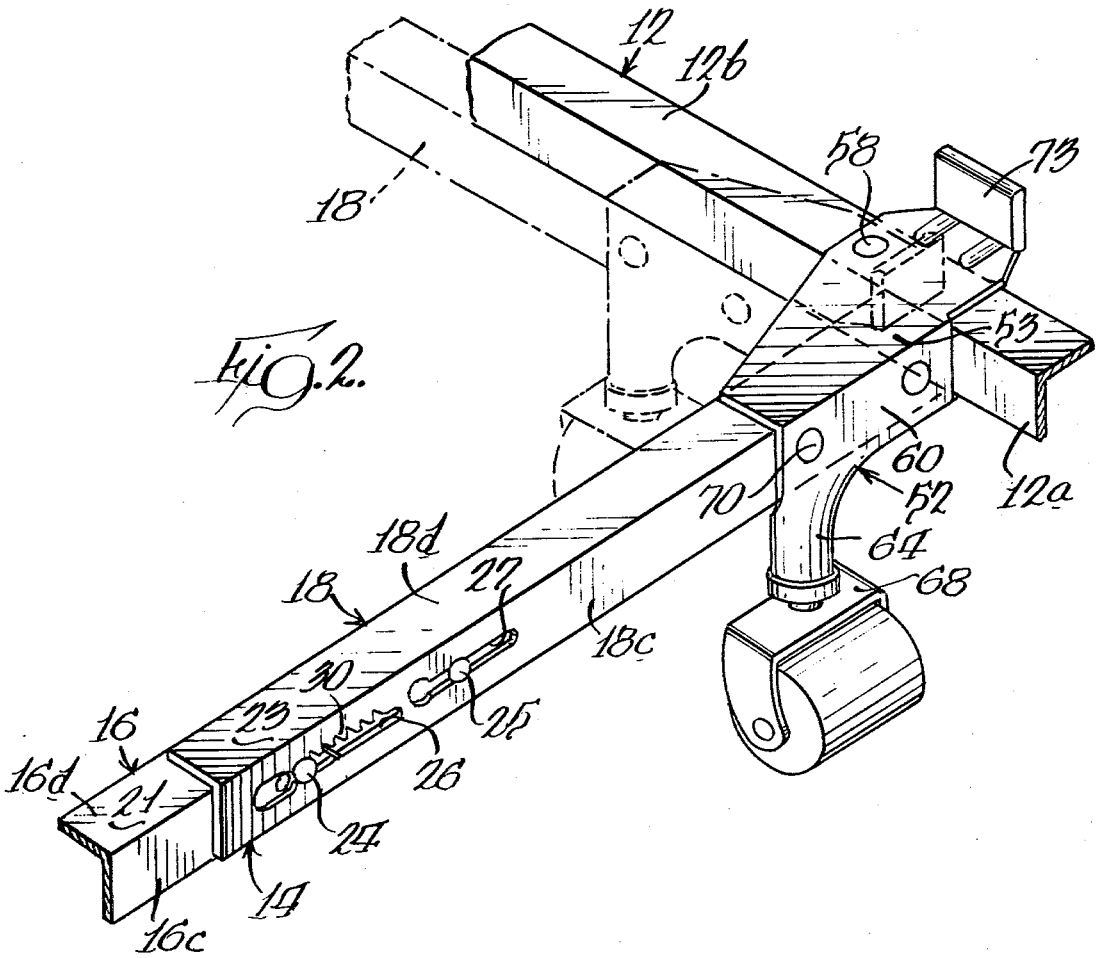
FIG. 2 is an enlarged view of a portion of the bed frame shown in FIG. 1 showing in phantom one of the end rail elements in a pivoted position.

To releasably lock together the first and second elements 16 and 18, it is preferred to provide two protrusions 24 and 25 spaced-apart along the axis of the first element 16, and two elongated openings 26 and 27 defined in the wall of the second element 18. Each of the openings is associated with one of the protrusions, so that one of the protrusions is received in each opening, as shown in FIGS. 2–4.

Figures 3, 4, 5:
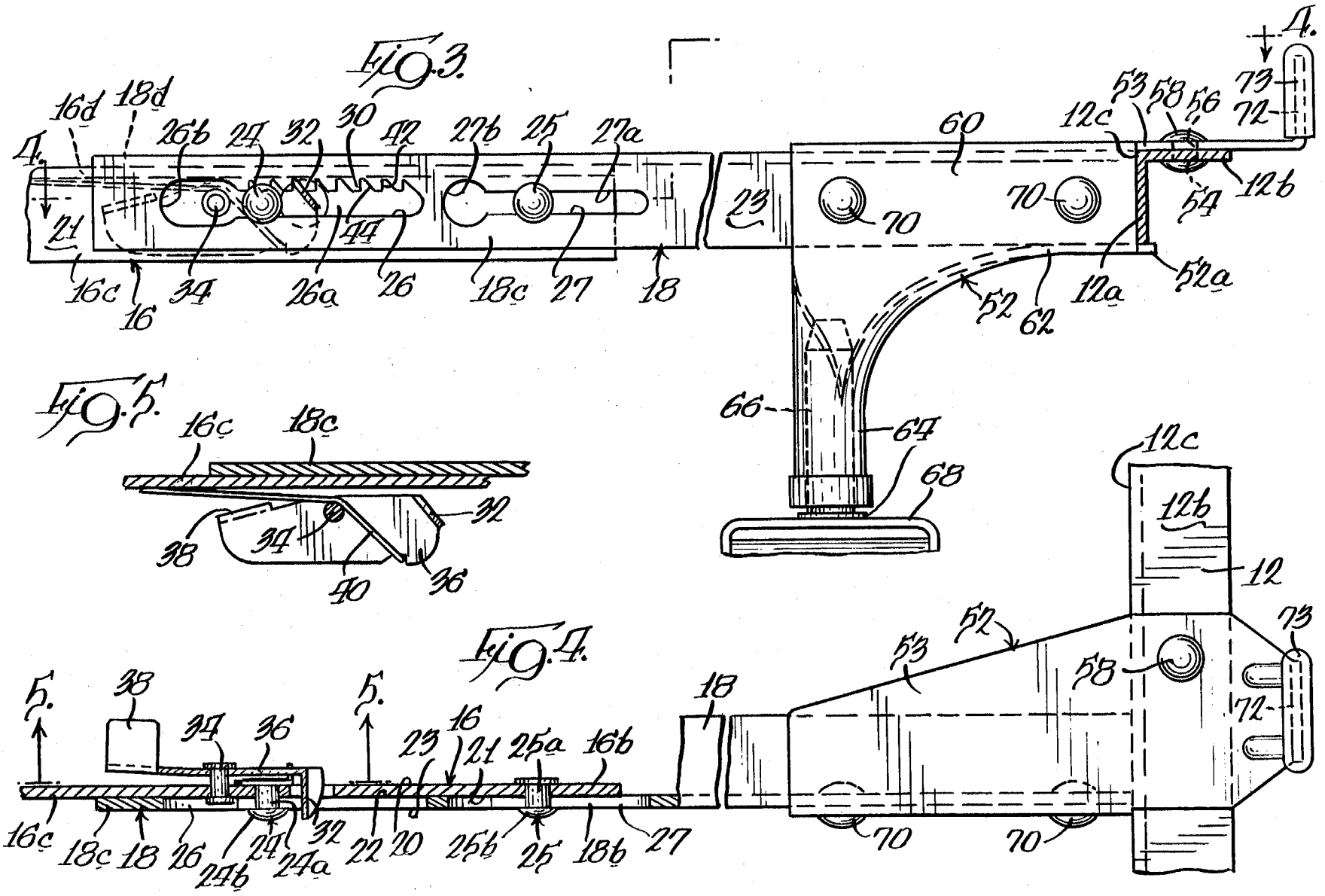
FIG. 3 is an enlarged fragmentary cross-sectional view taken along line 3—3 in FIG. 1.
FIG. 4 is a fragmentary cross-sectional view taken along line 4—4 in FIG. 3.
FIG. 5 is a fragmentary cross-sectional view taken along line 5—5 in FIG. 4.

As best shown in FIG. 3, each of the openings 26 and 27 is in the form of a longitudinally elongated keyhole slot having a narrow portion **26*a* and 27*a* extending for a major portion of the length of the openings and an enlarged portion 26*b* and 27*b*** at one end. The transverse width of the enlarged portion is greater than the predetermined width of the narrow portion.

Referring to FIG. 4, each protrusion 24 and 25 preferably is in the form of a rivet extending outwardly from the first element 16. Each rivet has a shank portion **24*a* and 25*a* which is similar in width but no wider than the predetermined width of the narrow slot portion 26*a* and 27*a* (FIG. 3) of the openings. Each rivet also has an enlarged head 24*b* and 25*b* having an external dimension with a diameter larger than the predetermined width of the narrow slot portion 26*a* and 27*a* of the openings and smaller than the width of the enlarged portion 26*b* and 27*b* of the openings. The shank portion 24*a* and 25*a* of each rivet has a length such that the enlarged head 24*b* and 25*b* of each rivet is spaced from the outer surface 21 of the first element by a distance at least as great as the thickness of the wall of the second element 18, thereby enabling the enlarged head 24*b* and 25*b* of each rivet to clear the wall of the second element. Each of the rivets is adapted for insertion through the enlarged portion of a selected one of the openings 26 and 27** when the first and second elements are positioned in engagement with one another.

To positively hold the first and second elements against separation, each rivet is inserted through the enlarged portion of the selected opening, and the first and second elements are moved longitudinally relative to one another so that the shank portion **24*a* and 25*a* of each rivet is positioned in the narrow slot portion 26*a* and 27*a* of one of the openings, and the enlarged head 24*b* and 25*b* of the rivets overlies a portion of the wall of the second element 18 adjacent to the narrow slot portions. As can be seen from FIGS. 2 and 4, the enlarged portion of each slot is positioned at the same end of each opening 26 and 27 so that the elements 16 and 18** can be moved axially relative to one another to releasably secure the elements together.

The present invention also includes means for adjusting the width of the bed frame. As shown in FIGS. 2 and 3, at least one of the openings, such as opening 26, has a plurality of teeth 30 along one edge (such as the upper edge) of the narrow slot portion **26*a*, and the teeth extend along the axis of the second element 18. A spring loaded pawl 32 is secured to the inner surface 20 of the first element 16, preferably near the second end 16*b* of the first element, and is receivable in the opening 26 to engage the teeth 30 one at a time. The pawl 32 is pivotably mounted to the first element 16 by a pin 34, and an arm 36 is attached to the pawl or may be integral therewith. A tab 38 is also attached to arm 36 or may be integral therewith to enable a person to operate the pawl 32. A wire spring 40 has a fixed end which engages the inner surface 20 of the first element 16 and urges the pawl 32 against the teeth 30 since the other end of the spring is attached to the arm 36. Due to the inherent resiliency of the spring 40**, the fixed end of the spring is held in place without additional securement means.

Each of the teeth 30 has two walls. The wall 42 (FIG. 3) which is further from the enlarged portion **26*b* of the opening 26 is generally vertical, and the wall 44 is sloping and is at an angle relative to horizontal and vertical. With this arrangement, the teeth face in a direction such that the pawl 32 is free to ride over the teeth 30 when the first and second elements 16 and 18** are moved inwardly toward one another.

The foregoing arrangement provides an advantage to the present invention that the pawl does not have to be manipulated to lessen the width of the bed frame—one merely has to push the elements 16 and 18 inwardly toward one another.

Engagement between the pawl 32 and one of the teeth 30 prevents the elements 16 and 18 from moving outwardly relative to one another. To increase the width of the bed frame, the tab 38 is pushed to release the pawl 32 from the teeth, and the elements 16 and 18 are pulled outwardly.

Where a pair of openings 24 and 25 are provided, and only one of the openings has teeth along a portion of its length, slight variations in the width of box springs and mattresses of a particular size (such as Hollywood, queen-size or king-size) can be accommodated. This feature is important because box springs of a particular size frequently vary by as much as an inch or so. Accordingly, it is only necessary to provide the teeth along a relatively short segment of the length of the second element 18.

Figure 6:
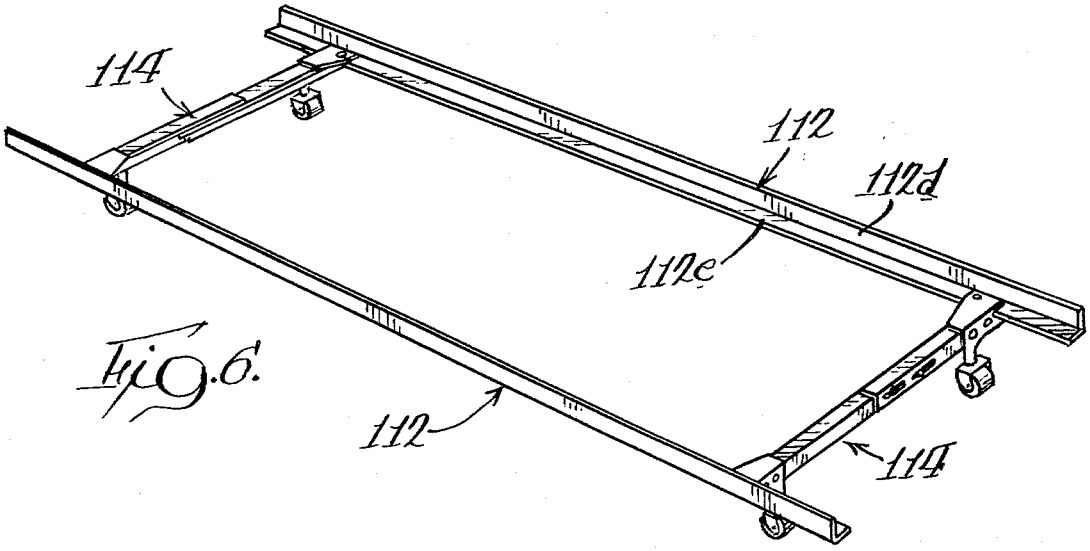
FIG. 6 is a perspective view of another embodiment of the present invention.

According to a further feature of this invention, the second element 18 has a plurality of openings which are spaced apart so that the first and second elements can accommodate bed frames of all sizes. Thus, as shown in FIG. 6, there is a pair of openings for each size of bedding to be accommodated, and one of the openings in each pair has a plurality of teeth along a portion of its length, as described above.

The side rails 12 and end rails 14 may be formed of angle iron which is generally L-shaped in cross-section and includes a vertical leg 12*a* and 14*a*, respectively, terminating in an upper edge and a generally horizontal leg 12*b* and 14*b*, respectively, which is integral with the upper edge of the vertical leg. Likewise, elements 16 and 18 may be formed of angle iron having an L-shaped cross-section, each element having a vertical leg 16*c* and 18*c*, respectively, terminating in an upper edge, and a horizontal leg 16*d* and 18*d*, respectively, which is integral with the upper edge of the vertical leg. The rivets 24 and 25 and the arm 36 of the pawl 32 are secured to the vertical leg 16*c* of the first element 16, and the openings 26 and 27 are defined by the vertical leg 18*c* of the second element 18 (FIG. 4).

Although the disclosed embodiments show elements 16 and 18 having an L-shaped cross-section, the present invention is equally applicable to a pair of elements having a channel-shaped construction such as those disclosed in the aforesaid U.S. Pat. No. 4,078,270 to Nowell.

According to a further feature of this invention, means is provided for pivotably mounting each of the first and second elements 16 and 18 to the respective side rails 12 so that the elements 16 and 18 can be rotated from a position generally perpendicular to the respective side rails to a position generally parallel to and alongside the respective side rails. The pivotable mounting means comprises a bracket 52 which includes a horizontal flange 53 having one end secured to the first end of one of the elements, such as second element 18 (FIGS. 2 and 4), and an opposite end which is pivotably mounted to one of the side rails 12.

To enable the pivoting to occur, the horizontal leg 12*b* of the side rails defines a through aperture 54 (FIG. 3) and terminates in an inner edge 12*c*. The flange 53 also defines a through aperture 56 adjacent one end of the flange, and a pin 58 extends through the apertures 54 and 56. The elements 16 and 18 are pivotable about the respective pins 58.

The aperture 54 in the horizontal leg of the side rail 12 has a center point which is spaced from the inner edge 12*c* of the horizontal member by a predetermined distance. When the element which is pivotably mounted to the side rail 12 is perpendicular to the side rail, and if all planes intersecting the element were extended through the side rail, the distance between the plane closest to pin 58 and the center point of pin 58 is at least as great as the aforementioned predetermined distance. Consequently, the pin 58 and the apertures 54 and 56 are offset from the axis of the element and all planes intersecting the element when the element is perpendicular to the side rail. Moreover, the distal end of the element pivotably connected to the side rail terminates at the inner edge 12*c* of the horizontal member or may be spaced-apart from the inner edge of the horizontal member.

As a result, each member is movable between a position generally perpendicular to the side rail 12 to which it is pivotably connected for supporting a mattress (as shown in solid lines in FIG. 2), and a more compact position (shown in phantom in FIG. 2) in which the element is parallel to and alongside and may engage the inner edge 12*c* of the horizontal member to which the element is pivotably mounted. The latter position is desirable for purposes of packing the bed frame so that the packed containers occupy less space than would otherwise be required for shipping.

As shown in FIGS. 2–4, the flange 53 overlies and is in surface to surface engagement with the outer surface 23 of the horizontal leg 18*d* of the second element 18. The bracket has a 90° fold and includes a vertical flange 60 that overlies and is in surface to surface engagement with the outer surface 23 of the vertical leg 18*d* of the second element. The bracket 52 is further folded and rolled to form a horizontal flange 62 which is adapted to engage the bottom edge of the vertical leg 18*d* of the second element, and formed to hold a suitable socket 64 to receive the stem 66 of a suitable swivel caster 68. Preferably, the socket 64 is spaced inwardly from the side rail 12 so that the caster 68 is out of reach of the feet of a person who may be making the bed. The vertical flange 60 of the bracket 52 and the vertical leg 18*d* of the second element are each provided with a pair of apertures so that the bracket can be secured to the second element by means of rivets 70.

As shown in FIG. 3, the bracket 52 may include an outwardly projecting lip 52*a* which underlies the vertical leg 12*a* of the side rail and is in surface to surface engagement with the bottom edge of the vertical leg 12*a* when the bed frame is assembled.

As shown in FIGS. 2 and 3, the outer edge of the flange 53 may include a vertical flange 72 extending upwardly therefrom and integral therewith for limiting transverse movement of a mattress on the bed frame. A cap 73 can be positioned over the flange 72.

In the embodiment illustrated in FIGS. 1–4, the side rails 12 are positioned such that the vertical leg 12*a* extends downwardly from the outer edge of the horizontal leg 12*b*. The flange 53 overlies and is in surface to surface engagement with what is shown as the upper and outer surface of the horizontal leg 12*b* of the side rail 12. Transverse movement of the mattress relative to the bed frame is limited by the vertical flange 72 of the bracket 52.

Figure 7:
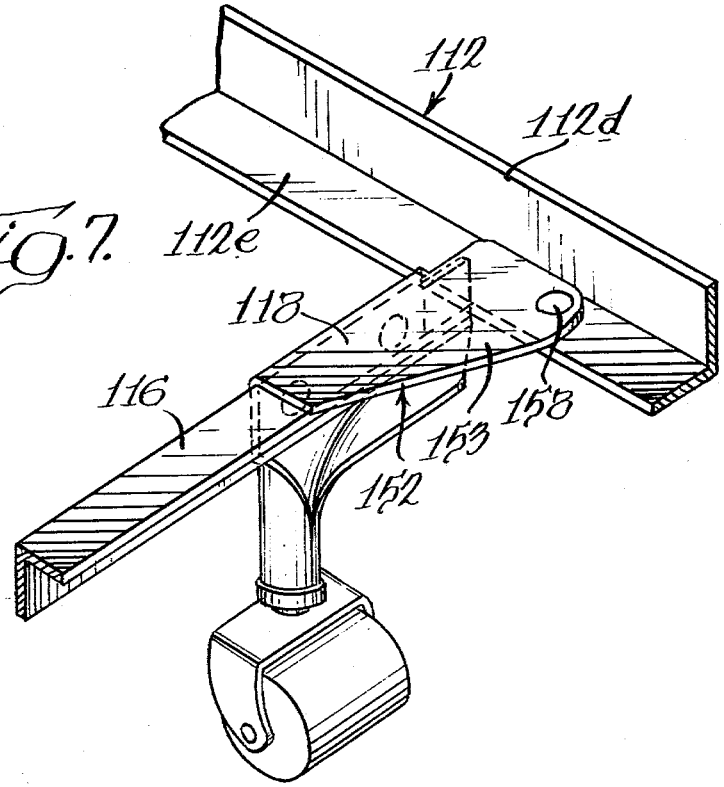
FIG. 7 is an enlarged view of a portion of the bed frame shown in FIG. 6.

In the embodiment illustrated in FIGS. 6 and 7, numerals in the 100 series are used, and the same last two digits in each numeral designate similar elements in the various embodiments.

Referring to FIGS. 6 and 7, the side rail 112 is positioned such that the vertical leg 112*d* extends upwardly from and is integral with the outer edge of the horizontal leg 112*e* of the side rail. The bracket 152 has a horizontal flange 153 that overlies and is in surface to surface engagement with the lower, outer surface of the horizontal leg 112*e*. Unlike the embodiment illustrated in FIGS. 1 and 2, the bracket 152 does not include an upwardly extending flange, because the vertical legs 112*d* of the side rails limit the transverse movement of the bed relative to the bed frame.

Element 116 is positioned such that the distal end contacts the edge of horizontal leg 112*e* when element 116 is perpendicular to the side rail, thereby preventing further rotation of the element 116 relative to the side rail 112 when the desired position is reached. Also, to provide additional strength, the bracket 152 includes a vertical flange and a portion of the vertical flange underlies horizontal leg 112*e* when the element 116 is perpendicular to the side rail. Except as discussed above, the embodiment of FIGS. 6 and 7 corresponds to the embodiment shown in FIGS. 1 and 2.

What is claimed is:

1. An adjustable bed frame for supporting mattress means in spaced relationship to a floor, comprising: a pair of spaced, parallel, horizontally disposed side rails, a pair of spaced, parallel, horizontally disposed end rails extending substantially transversely between said side rails for holding said side rails in spaced, parallel relationship, each end rail including first and second elongated elements each having at least one wall with an outer surface and an inner surface, said first element having a first end mounted to one of said side rails and said second element having a first end mounted to one end of the other of said side rails, each of said elements having a second end disposed in slidable relationship to one another along the axis of said elements with the outer surface of the wall of said first element facing and engaging the inner surface of the wall of said second element, at least one protrusion extending outwardly from the outer surface of the wall of said first element, means defining at least one elongated opening in the wall of said second element permitting said protrusion to be inserted when said first and second elements are positioned in engagement with one another, said opening having an edge defining a plurality of teeth extending along the axis of said second element, spring loaded pawl means secured to said first element and receivable in said opening to engage said teeth one at a time, said teeth facing in a direction such that said pawl is free to ride over said teeth when said first and second elements are moved inwardly toward one another, engagement between said pawl and one of said teeth preventing said first and second elements from moving outwardly relative to one another, each protrusion comprising a rivet having a head portion and a shank portion, said elongated opening having an enlarged diameter portion through which the head portion of the rivet is receivable, and an elongated narrow portion of predetermined transverse width which is greater than the diameter of the shank portion of the rivet and less than the diameter of the head portion of the rivet, whereby said first and second elements are positively held against separation.

2. An adjustable bed frame as defined in claim 1 wherein said elements are generally L-shaped in cross-section and include a generally vertical leg having an upper edge and a generally horizontal leg integral with the upper edge of the vertical leg, said projection and said pawl means are secured to the vertical leg of said first element, and said opening in defined in the vertical leg of said second element.

3. An adjustable bed frame as defined in claim 1 wherein said pawl means is positioned near said second end of said first element.

4. An adjustable bed frame as defined in claim 1 wherein said teeth are provided along a short segment of the length of said second element.

5. An adjustable bed frame as defined in claim 1 wherein two protrusions spaced-apart along the axis of said first element are secured to said first element, and two elongated openings are defined in said wall of said second element, each of said openings being associated with one of said protrusions.

6. An adjustable bed frame as defined in claim 1 wherein each of said openings is in the form of a longitudinally elongated slot having an elongated narrow portion of predetermined transverse width and an enlarged portion at one end of transverse width greater than said predetermined width, and each protrusion is in the form of a rivet extending outwardly from said first element, each rivet having a shank portion similar in width to said narrow slot portion and an enlarged head having an external dimension larger than said narrow slot portion and smaller than said enlarged portion, said shank portion being of a length allowing said enlarged head to clear said wall of said second element, each of said rivets being adapted for insertion through the enlarged portion of a selected one of said openings when said first and second elements are positioned in engagement with one another, each of said rivets being positioned in the narrow slot portion of one of said openings when said first and second elements are moved longitudinally relative to one another so that said first and second elements are positively held against separation.

7. An adjustable bed frame as defined in claim 1 further including means for pivotably mounting each of said first and second elements to said respective side rails so that said elements can be rotated from a position generally perpendicular to said respective side rails to a position generally parallel to and alongside said respective side rails.

8. An adjustable bed frame as defined in claim 7 wherein said means for pivotably mounting includes a plate having one end secured to said first end of one of said elements and an opposite end which is pivotably mounted to one of said side rails.

9. An adjustable bed frame for supporting mattress means in spaced relationship to a floor, comprising: a pair of spaced, parallel, horizontally disposed side rails, a pair of spaced parallel, horizontally disposed end rails extending substantially transversely between said side rails for holding said side rails in spaced, parallel relationship, each end rail including first and second elongated elements each having at least one wall with an outer surface and an inner surface, said first element having a first end mounted to one of said side rails and said second element having a first end mounted to one end of the other of said side rails, each of said elements having a second end disposed in slidable relationship to one another along the axis of said elements with the outer surface of the wall of said first element facing and engaging the inner surface of the wall of said second element, at least one protrusion extending outwardly from the outer surface of the wall of said first element, means defining at least one elongated opening in the wall of said second element permitting said protrusion to be inserted when said first and second elements are positioned in engagement with one another, said opening having an edge defining a plurality of teeth extending along the axis of said second element, spring loaded pawl means secured to said first element and receivable in said opening to engage said teeth one at a time, said teeth facing in a direction such that said pawl is free to ride over said teeth when said first and second elements are moved inwardly toward one another, engagement between said pawl and one of said teeth preventing said first and second elements from moving outwardly relative to one another, means for pivotably mounting each of said first and second elements to said respective side rails so that said elements can be rotated from a position generally perpendicular to said respective side rails to a position generally parallel to and alongside said respective side rails, wherein said side rails include a generally horizontally extending member for supporting said mattress means, said horizontal members each terminate in an inner edge and define a through aperture, and said means for pivotally mounting includes a generally horizontally extending plate having one end fixedly secured to said first end of one of said elements and a second end, said plate defining a through aperture adjacent said second end, and pin means extend through said apertures in each of said horizontal members and said respective plates, said elements being pivotable about said respective pin means.

10. An adjustable bed frame as defined in claim 9 wherein said aperture in said horizontal member has a center point which is spaced from said inner edge of said horizontal member by a predetermined distance, and the distance between said center point and said elements along the axis of said side rail when said elements are perpendicular to said side rail is at least as great as said predetermined distance.

11. An adjustable bed frame as defined in claim 9 wherein said pin and said apertures in said horizontal member and said plate are offset from the axis of said elements when said elements are perpendicular to said side rail.

12. An adjustable bed frame as defined in claim 9 wherein said plate includes a generally vertical flange extending upwardly from said plate to limit transverse movement of said mattress means.

13. An adjustable bed frame as defined in claim 9 wherein said plate includes a downwardly extending vertical flange, and said plate is secured to one of said elements along said downwardly extending vertical flange.

14. An adjustable bed frame as defined in claim 13 wherein wheel means for confronting said floor is fixed to said downwardly extending vertical flange.

15. An adjustable bed frame as defined in claim 7 wherein said end rails and said side rails have upper surfaces which are generally coplanar.

16. An adjustable bed frame as defined in claim 2 wherein said side rails include a generally horizontally extending member for supporting said mattress means, said horizontal members each terminating in an inner edge and defining a through aperture, said bed frame further including means for pivotably mounting each of said first and second elements to said respective side rails so that said elements can be rotated from a position generally perpendicular to said side rails to a position generally parallel to and alongside said respective side rails, said means for pivotally mounting including a folded plate including a horizontally extending section which defines a through aperture alignable with the through aperture in said horizontal member, pin means extending through said through apertures so that said plate is pivotable about said pin means, said plate including a downwardly extending vertical flange which is rigidly secured to said vertical leg of one of said elements.

17. An adjustable bed frame member adapted to extend transversely between a pair of horizontally disposed further bed frame members so as to hold said further bed frame members in spaced, parallel relationship, said adjustable member comprising first and second elongated elements each having at least one wall with an outer surface and an inner surface, said first element having a first end mounted to one end of one of said further bed frame members and said second element having a first end mounted to one of the other of said further bed frame members, each of said elements having a second end disposed in slidable relationship to one another along the axis of said elements with the outer surface of the wall of said first element facing and engaging the inner surface of the wall of said second element, at least one protrusion extending outwardly from the outer surface of the wall of said first element, means defining at least one elongated opening in the wall of said second element permitting said protrusion to be inserted when said first and second elements are positioned in engagement with one another, said opening having an edge defining a plurality of teeth extending along the axis of said element, spring loaded pawl means secured to said first element and receivable in said opening to engage said teeth one at a time, said teeth facing in a direction such that said pawl is free to ride over said teeth when said frame members are moved inwardly toward one another, engagement between said pawl and one of said teeth preventing said frame members from moving outwardly relative to one another, each protrusion comprising a rivet having a head portion and a shank portion, said elongated opening having an enlarged diameter portion through which the head portion of the rivet is receivable, and an elongated narrow portion of predetermined transverse width which is greater than the diameter of the shank portion of the rivet and less than the diameter of the head portion of the rivet, whereby said first and second elements are positively held against separation.

* * * * *